US006382829B1

(12) United States Patent
Ursula

(10) Patent No.: US 6,382,829 B1
(45) Date of Patent: May 7, 2002

(54) WATCH CASE EQUIPPED WITH DECORATION PIECE

(75) Inventor: Von Burg Ursula, Grenchen (CH)

(73) Assignee: Aurema SA (CH)

( * ) Notice: Subject to any disclaimer, the term of this patent is extended or adjusted under 35 U.S.C. 154(b) by 0 days.

(21) Appl. No.: 09/517,787

(22) Filed: Mar. 2, 2000

(30) Foreign Application Priority Data

Mar. 4, 1999 (EP) ..... 99810192

(51) Int. Cl.[7] ..... G04B 37/18
(52) U.S. Cl. ..... 368/285; 368/281; 368/276
(58) Field of Search ..... 368/281, 282, 368/285, 294, 295

(56) References Cited

FOREIGN PATENT DOCUMENTS

| | | |
|---|---|---|
| CH | 507549 | 5/1971 |
| CH | 513453 | 5/1971 |
| EP | 738942 | 10/1996 |

*Primary Examiner*—Bernard Roskoski
(74) *Attorney, Agent, or Firm*—Ostrolenk, Faber, Gerb & Soffen, LLP

(57) ABSTRACT

The invention is related to a watch case equipped with a decoration piece (50) which has the particularity of being difficult to machine and having moreover dimensions of rather wide tolerances, namely plus or minus about a tenth of a millimeter around a reference dimension, whereas the manufacturers of the watch cases are able to ascertain usually a precision in the order of a hundredth of a millimeter. This handicap is overcome in providing a clearance between the decoration piece and the adjacent elements (20, 30), namely the middle of the watch and the bottom, and thanks to means (60, 70) ascertaining the maintenance of these clearances, these means exerting at the same time the functions of tightness and of shock dampening where the shocks occur on the clockwork-movement (10) or on the decoration piece (50), or on both.

12 Claims, 2 Drawing Sheets

WATCH CASE EQUIPPED WITH DECORATION PIECE

BACKGROUND OF THE INVENTION

1. Field of the Invention

The present invention relates to a watch case, equipped at its circumference with a decoration piece that extends around a middle part of the case to which are connected a back cover and a glass plate, an inner surface of the middle part surrounding a clockwork movement supported by a circular piece and connected to a crown through an arbor.

2. Description of the Prior Art

The problem associated with the manufacture of watches of this type where the decoration piece is present for esthetic reasons only, is based on the incompatibility of the manufacturing precision figures when the decoration piece is made from a very hard and only low resilient material such as glass, crystal glass or precious or semi-precious stones; this problem is well known to watchmakers. In fact, whereas the cases are manufactured with a precision in the order of 0.01 mm, this precision cannot be respected with the above-mentioned hard materials where internal tensions are present which may lead to fissures and fractures of the machined material. The manufacturers cannot generally offer a better precision than about 0.1 mm, considerable deviations of the dimensions of different pieces which are successively manufactures being further unavoidable.

It is therefore highly desired to compensate the allowances described above.

Efforts have already been made to solve the problem. Thus, Swiss patent specification No. CH-A-654,167 discloses a watch case comprising an annular piece 7 made from a material whose machining is very difficult. However, the proposed means do really not bring about a solution of the above-depicted problem since certain portions of said piece must still be machined in order to respect precise dimensions (page 4, left column, lines 19 ff.). Now, it is just this type of machining which should be made superfluous by the present invention.

European patent No. EP-B1-0,150,746 also describes a watch case comprising a middle portion formed by two concentric rings, namely an inner ring which constitutes the very middle portion of the watch case, surrounding the clock movement, and an outer ring (or annular piece or decoration piece) exerting before all a decorating function. However, this piece, maintained between a bottom and a frontal plate (covering the inner ring on which it is cemented), must have essentially the same thickness as the inner ring. In fact, it is stated that, should the decoration piece be separated from the middle of the case by a seal, it is axially retained by the clamping force between the bottom and the frontal plate only, no other fastening means being provided. This solution is therefore not satisfactory since the thickness of the decoration piece must necessarily be machined in respecting, here again, precise dimensions. If, on one hand, the thickness of the outer decoration ring is higher than the required dimension value, the bottom cannot be correctly fastened against the middle portion (the inner ring), which will lead in a mostly undesired manner to a very rapid breakdown of the watch since neither the tightness nor the dampening of shocks are assured any longer; moreover, the decoration piece will be damaged during the mounting of said bottom on the middle portion. If, on the other hand, the thickness of that outer ring is lower than the required dimension value, it will begin to move in axial direction, and this movement will damage the ring with time, together with the undesired unaesthetic effect caused by a not wanted liberty movement.

Furthermore, the problems caused by the differences between the dilatation coefficients of the metal forming the middle portion of the case and the material from which the decoration piece is made, are even not dealt with and still less resolved.

SUMMARY OF THE INVENTION

The purpose of this invention is to overcome the above-discussed disadvantages. This purpose is fulfilled by a watch case of the above-indicated kind wherein clearances are provided between the decoration piece and the middle of the case and the bottom, respectively, in such a manner that said decoration piece is out of contact with the middle and with the bottom, and wherein means are provided and established in order to maintain said clearances.

Further features, advantages and special realizations of the invention will become evident from the following description and from the dependent claims whose contents are incorporated by reference into this specification.

The implementation of the means according to the invention is particularly advantageous not only because the drawbacks associated with the watch cases of the prior art are overcome, but also because the proposed present solution is remarkably simple, elegant and cheap. Moreover, the same means fulfill simultaneously and in an ideal fashion the functions of tightness and shock absorption. These means allow to realize the ideal synthesis always searched for, namely manufacturing costs reduced to a minimum, functioning reliability in all situations, selected esthetics and possible or polyvalent presentation variations.

A special embodiment of the invention will now be described in detail as a non-limiting example thereof, and reference is made to the attached drawing.

DETAILED DESCRIPTION OF THE INVENTION

Figure 1:
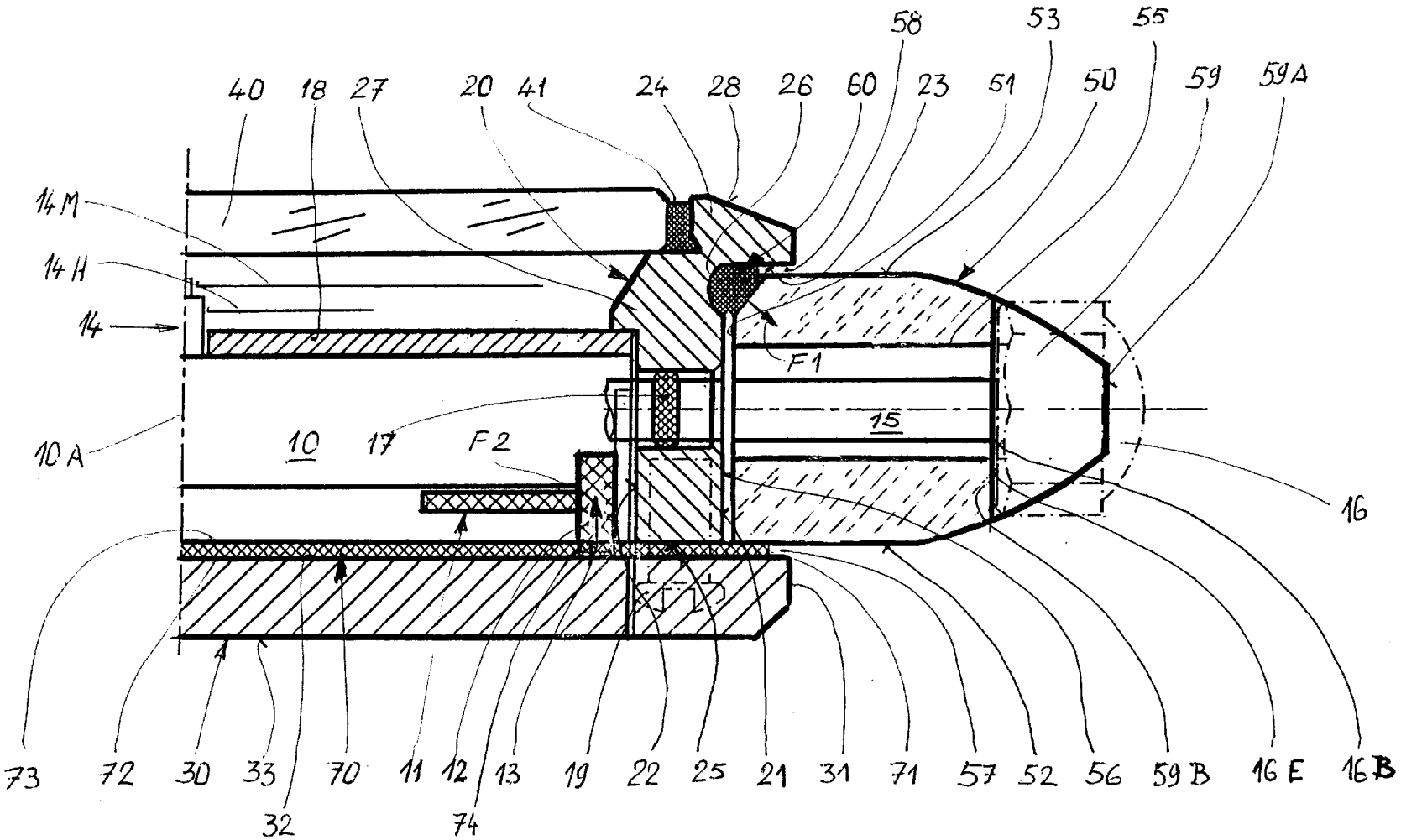
FIG. 1 shows a half sectional view in the plane of 9.00 to 3.00 o'clock.
Figure 2:
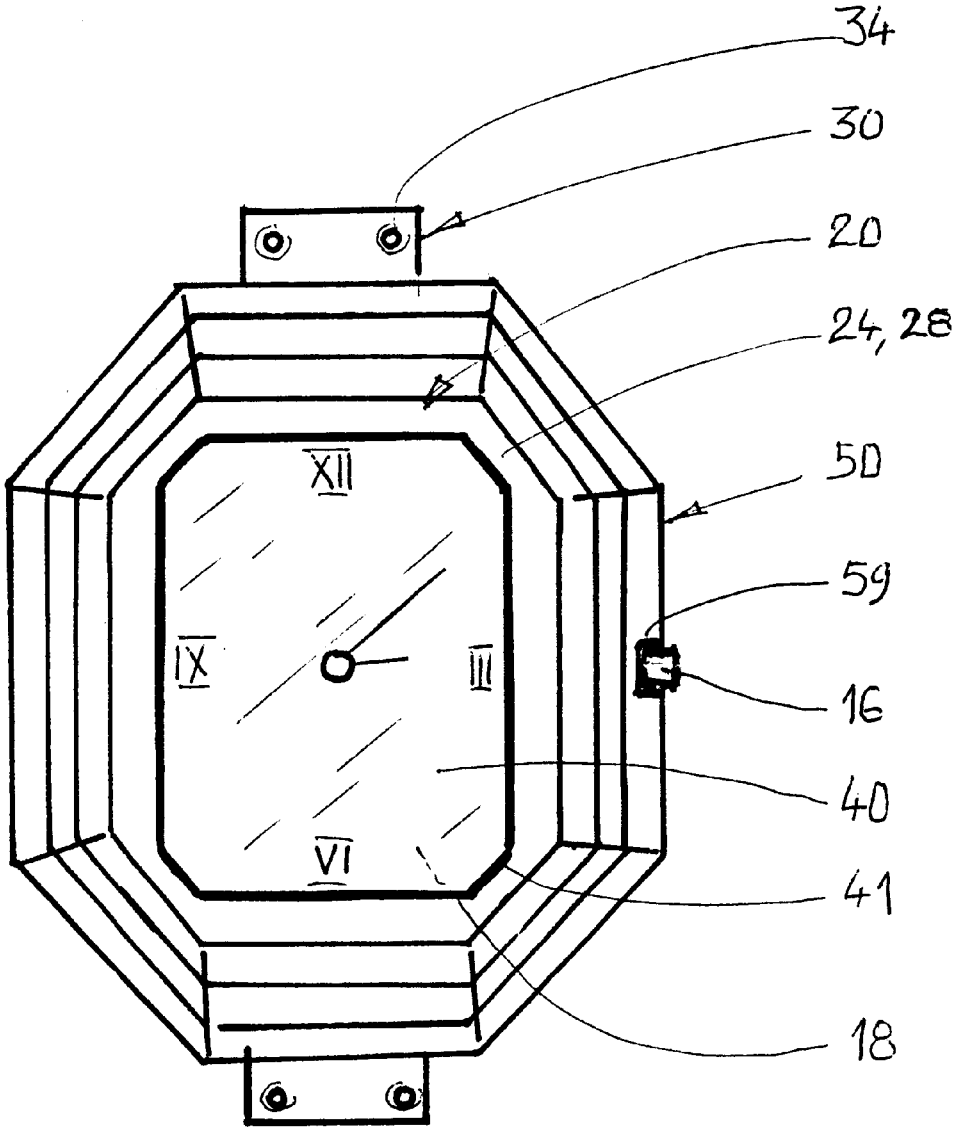
FIG. 2 is a partial top view at another scale.

The wrist watch can be seen in FIG. 1; the watch comprises a clockwork-movement 10 with a central axis 10A, supported on a circular plate 11, of a type known per se. It may be a mechanical movement, a quartz movement, etc., with a display by hands or with a digital display. The shown movement comprises hands 14H (for hours) and 14M (for minutes), driven on the hour-wheel arbor and the cannon-pinion arbor, respectively, generally indicated by 14, as well as a dial face 18. All these elements are stowed in a case composed of a middle portion 20, a bottom 30 and a glass cover 40 which is connected to the middle portion 20 by means 41. The middle 20 surrounds by its inner face 22 the set composed of the movement 10 and the circular plate 11 and comprises a nose or notch 27 which retains said dial face. The bottom is fastened under the middle, preferably in a removable manner, by means of fastening elements, for example by four screws 19 distributed at 1:30, 4:30, 7:30 and 10:30 o'clock. A hand-setting rod 15, traversing the middle 20, is also (partially) shown with its crown 16 (in fine dash-dot lines) and a seal 17. Until now, the shown elements are conventional ones and follow a usual and known construction, it being understood that the case itself may take different shapes (circular, oval, rectangular as shown in FIG. 2, etc.).

The middle 20 comprises an outer lateral face 21 opposed to the inner face 22, these two faces extending in parallel to the axis 10A of the watch case, and further comprises a lower plane surface 25 orthogonal to the axis 10A and facing the bottom 30. At the opposite, namely in the upper part, the middle comprises a shoulder 24. A surface 23 of this shoulder which is preferably parallel to the face 25, is oriented against the latter. The upper, visible surface of this shoulder is referenced as 28. As to its composition, the middle may be made of different materials, especially of a metal such as steel, yellow or white gold, a combination of these two gold types, etc. The surface 28 may be provided with decoration or jewelry elements. It may comprise, for example, mounted precious or semi-precious stones.

The bottom 30 is composed of a preferably plane metallic plate that is delimited by its inner face 32, its outer face 33, and its lateral faces 31. It comprises (see FIG. 2) sides 6:00 and 12:00 o'clock, and connecting means 34 for fastening a wristband, as it is known to the one skilled in the art.

The case is completed by a decoration piece having essentially an esthetical function, or annular piece 50. The shape of this annular piece should of course be understood in its largest sense, i.e. it is not limited to a circular shape. According to the present Example, this piece 50 is made from a hard and brittle material, thus difficult to be machined, such as glass. It surrounds the middle 20—which determines its shape, seen from above (see FIG. 2)—and is clamped between the middle and the bottom 30 under the conditions to be described below. As to its sectional shape, according to the representation of FIG. 1, it is defined by the inner face 51 (disposed opposite to the face 21 of the middle), lower face 52, upper face 53 and laterally outer face 59A. The faces 52, 53 are partially covered, respectively by the lower face 32 of the bottom and the lower face 23 of the shoulder 24 of the middle. The faces 52, 53 are preferably parallel to each other at the regions where they are covered as described. Clearances 56, 58, 57 which will be described later in detail extend between the faces 51 and 21; 53 and 23; and 52 and 32, respectively. The piece 50 has a boring 55 in the axis of 9:00 to 3:00 o'clock for allowing the passage of the hand-setting rod 15. The diameter of this boring may be greatly superior to that of the rod. The boring opens into a groove or notch 59 having a usual and known shape, see FIG. 2, for permitting the operation of the crown 16 fixed to the outer end of the rod 15. Since the piece 50 is a decoration piece, the structure, the relief and the finishing of the face 53 are particularly carefully done whereas the choice of the material and the quality are also determined by a sophisticated esthetic.

The piece 50 cooperates further with means 60, 70 permitting to maintain the clearances 56, 58, 57 and, consequently, to avoid that the decoration piece comes into contact with the neighboring elements, namely, the middle 20 and the bottom 30.

These means fulfill at the same time the functions of tightness and of shock dampening.

According to a preferred realization, these means are dissociated, namely, composed of first and second means referenced as 60 and 70, respectively.

The first means 60 are advantageously constituted by at least one compressible annular element, disposed within the angular region formed by the faces 21 and 23 of the middle 20 and the corresponding faces of the piece 50. According to the Example, the means are composed by a toric sealing ring 60 partially seated within a groove 26. The seal may exert, when the bottom 30 is mounted on the middle 20 by means of the screws 19, a reaction force F1 by seating upon a chamfer 54 that breaks the angle of the faces 51, 53. The dimensions of the means 60 are defined such as to ascertain a clearance or gap 56 between the above described faces 21, 51 and a gap 58 between the faces 23, 53 in a reliable manner and especially during said mounting, said clearance not falling below a limiting value of, say, a tenth of a millimeter which allows to take care of the decoration piece under all conditions.

The second means 70 are constituted by an annular or a plane piece, according to the particular embodiment. Seen in the section shown in FIG. 1, this piece 70 is plane like the bottom 30 on which it is laid down. Its shape may be geometrically defined by its outer, inner and lateral exterior faces which are referenced by the numerals 72, 73 and 71, respectively; in its annular embodiment, the piece 70 is necessarily additionally defined by its inner lateral face that is symbolically shown in FIG. 1 by the reference 74. The means 70 are made of a soft and compressible material. If the piece 70 is a plane annular or a solid (full) one, it carries the reference 70.

In FIG. 1, the means 70 correspond to the solid piece. They are disposed on the inner face 32 of the bottom 30, the lateral exterior face 71 being on a level with the lateral face 31 of the bottom 30 or, see FIG. 1, slightly retracted therefrom. According to the annular embodiment (not shown), the piece 70 should extend under the lower face 25 of the crown, under the lower face 13 of the ring 12 of the circular piece 11, and partially under the face 52 of the decoration piece 50. This will say that the inner lateral face (symbolically shown by the reference 74) is on a level with the inner face (without reference numeral) of said ring 12 or, for a better safety, slightly exceeds the limit 74 in the direction of the axis 10A of the clockwork-movement.

This minimal width of the crown of the annular piece (when this variant is selected) that extends between the faces 71 and 74 (or even slightly further from the latter) is important.

The reason thereof will now be explained. It is first reminded that, on one hand, the precision of the dimensions of the decoration piece after finishing is rather high compared with the usual manufacturing precision of especially the middle part. On the other hand, it is one aim of the invention to avoid damages such as the formation of fissures and fractures of the decoration piece, be it during manufacture and machining or be it during the mounting of the bottom to the middle, and to avoid tightness and shock absorption defects. All these damages or defects may be caused by pinch of said piece. Furthermore, it is intended to take advantage from the constraint based on the finishing imprecision of this piece 50.

Thus, at a first place, such reference dimensions should be selected for the manufacture of the piece 50 that, disregarding the means 60, 70, the theoretical clearance between the faces 21 and 51 be at least equal to a tenth of a millimeter, plus a predetermined value (D1+S1), and that the thickness between the faces 52, 53, measured in the regions where they are parallel and covered by the shoulder 24 and the bottom, corresponds to the distance between the planes 23, 25 of the middle minus a value in the order of a tenth of a millimeter, and minus a predetermined value (D2+S2).

The values D1, D2 are provided and calculated in order to absorb the effects following from the differences between the dilatation coefficient of the metal (middle 20 and bottom 30) and that of the mineral element (decoration piece 50), the first being sensibly greater than the second. This is another considerable advantage brought about by the providing of clearances between the decoration piece 50 and the neighboring elements that are preferentially made from a metal. The values Si, S2 constitute safety margins. They may be in the order of a tenth of a millimeter or slightly lower.

Under these conditions, and taking into account the manufacturing allowances mentioned above and regarding especially the clearance 56, when the final dimension at the end of machining the face 51 of the piece 50 is at its highest limit, a very slight clearance equivalent to (D1+S1) will still separate this face from the face 21 of the middle.

The assembled watch case has the configuration that is shown in FIG. 1.

Thanks to the means 60, the clearances 56 and 58 are maintained in a reliable manner, these means exerting furthermore and simultaneously a sealing function and a shock dampening function in order to take care of the decoration piece 50.

However, if the means 60 resolve a part of the problem set forth above, they may create a new one, namely a possible defect of the shock dampening function on the movement 10. In fact, hypothetically, if the thickness of the piece 50 corresponds at its maximal allowance on one hand and, on the other hand, the piece 70 when it has an annular shape, extends only under the face 25 and partially under the face 52 and is compressed at this regions by the tightening action of the means fastening the bottom to the middle, the circular piece 11 may be not or only insufficiently held, and the clockwork-movement 10 may "swim" at every wrist movement and be subject to all shocks. Under the opposite hypothesis that the piece 50 has its minimal thickness allowance (and the piece 70 is the same), this defect does not occur; regarding the piece 50, it will be sufficiently maintained thanks to the play of a sufficient compression of the means 70.

In fact, the phenomenon of insufficient holding of the clockwork-movement has been observed with certain ones of the first prototypes which were all equipped with an annular piece 70 which extended only under the face 25 of the middle 20 and partially under the face 52 of the piece 50 (as defined above).

It was therefore necessary to resolve this new problem. This could be done in designing a piece 70 that extends also additionally at least under the circular piece 11. Thanks to this feature, the clockwork-movement is safely blocked, namely the function of dampening shocks on the movement is well fulfilled. Simultaneously, the decoration piece 50 remains maintained in an ideal manner. In this way, the means 60, 70 cooperate for exerting simultaneously the triple function of clearance, of sealing and of dampening shocks against the clockwork-movement 10 and against the decoration piece 50.

According to another embodiment (not shown), the means 60, 70 may be monolithic ones, i.e. that they are connected to each other through a tubular envelope made of semi-rigid synthetic material whose circumference, seen from above, corresponds to the circumference of the faces 21, 51. In this case, the reference dimensions of the recess of the decoration piece 50 will be such that the latter may easily be slipped on said envelope.

Finally, it is to be observed that the present inventive conception comprises the provision of a clearance 16E between the inner face 16B of the crown 16 and the outer lateral face 59B of the piece 50. In an analogous manner, other clearances (not referenced) are provided on both sides of the crown 16. The determination of this clearance 16E and the other that are perpendicular thereto can be established in taking the clearances 56, 58 as a model.

It can easily be seen that the application field of the present invention is extremely wide, and that the invention may be out into action also in such cases where one is not bound by any constraint caused by machining.

What is claim is:

1. A watch case, comprising:

a bottom of the case; a glass plate above and spaced from the bottom to define a space between the bottom and the plate;

a clockwork movement in the space;

a crown connected with the movement;

a middle of the case surrounding and defining the space for the clockwork movement; the middle having a bottom face to which the bottom of the case is connected; the middle having a top face to which the glass plate is connected;

a circular piece in the space and around the clockwork movement and supporting the clockwork movement;

a one piece decoration piece extending completely around the circumference of the middle of the case;

a first clearance setting element between the middle and the decoration piece for defining a first clearance between the decoration piece and the middle;

a separate second clearance setting element between the decoration piece and the bottom of the watch case for defining a second clearance between the decoration piece and the bottom of the watch case, such that the decoration piece is out of contact with the middle and out of contact with the bottom of the watch case; and wherein the first clearance setting elements exert force on the decorative piece for maintaining it in position and having a tendency to oppose reduction of the clearances within predefined limits.

2. The watch case of claim 1, wherein the middle of the case has an inner circumferential face facing into the space and an opposite outer circumferential face facing outward toward the decoration piece; the bottom of the watch case has an upper face;

the decoration piece has an inner circumferential face disposed opposite to the outer face of the middle; the decoration piece further having a lower face and an opposite upper face;

the lower face of the decoration piece being partially covered by the upper face of the bottom of the watch case;

the upper face of the decoration piece opposing the middle of the watch case; and the clearances extend between the upper face of the watch case bottom and the lower face of the decoration piece and between the upper face of the decoration piece and the middle of the watch case.

3. The watch case of claim 2, wherein the middle of the watch case includes a shoulder at the upper face of the decoration piece, the shoulder has a lower face which opposes the upper face of the decoration piece, and the first clearance is between the lower face of the shoulder and the upper face of the decoration piece opposing the lower face of the shoulder.

4. The watch case according to claim 3, wherein the first clearance is between the shoulder and the upper face of the decoration piece, there is a third clearance between the outer face of the middle and the opposing inner face of the decoration piece; and the first and third clearances define a junction between them; the first clearance setting element is disposed in the region of the junction;

the second clearance setting element is disposed on the upper face of the bottom of the watch case, and the second clearance setting element is opposite and below the circular piece and below the bottom face of the middle and below the lower face of the decoration piece.

5. The watch case of claim 4, wherein the decoration piece includes a chamfer at the upper face which is engaged by the first clearance setting element.

6. The watch case of claim 3, wherein the decoration piece includes a chamfer at the upper face which is engaged by the first clearance setting element.

7. The watch case of claim 6, wherein the first clearance setting element comprises a toric shape seal disposed in the clearance between the middle of the case and the chamfer on the decoration piece and wherein the shoulder of the middle includes a face opposing the chamfer in which a groove is defined for receiving the toric shape seal.

8. The watch case of claim 1, wherein the second clearance defining element comprises a plane piece of a compressible material, the piece of compressible material having a lateral face with a circumference, the bottom of the watch case also having a lateral face with a circumference, and the circumferences of the compressible material and of the bottom of the case having a geometry that is at least approximately corresponding;

the lateral face at the periphery of the piece of compressible material is over the upper face of the bottom of the watch case; the piece of compressible material having a lower face supported on the upper face of the bottom of the case and the piece of the compressible material having an upper face disposed below the middle and below the circular piece located in the space.

9. The watch case of claim 1, wherein the first and second clearance defining elements are adapted to define the same degree of tightness and shock-dampening.

10. The watch case of claim 1, wherein the decoration piece includes a groove for lodging of the crown therein and the groove and crown being respectively so shaped that clearances are provided between the decoration piece groove and the crown therein.

11. The watch case of claim 1, further comprising fastening elements for mounting the bottom of the case on the middle in a removable manner.

12. The watch case of claim 1, wherein the decoration piece is made of a hard material.

* * * * *

UNITED STATES PATENT AND TRADEMARK OFFICE

CERTIFICATE OF CORRECTION

PATENT NO. : 6,382,829 B1
DATED : May 7, 2002
INVENTOR(S) : Ursula Von Burg

It is certified that error appears in the above-identified patent and that said Letters Patent is hereby corrected as shown below:

Title page,
Item [12], should read: -- [12] United States Patent
Von Burg --
Item [75], should read: -- [75] Inventor: Ursula Von Burg, Grenchen (CH) --

Signed and Sealed this

Eighteenth Day of February, 2003

JAMES E. ROGAN
*Director of the United States Patent and Trademark Office*